US005771733A

United States Patent [19]

Tomat et al.

[11] Patent Number: 5,771,733

[45] Date of Patent: Jun. 30, 1998

[54] COMPACT ROLLING BLOCK

[75] Inventors: Ferruccio Tomat; Attilio Sacchi; Gianni Nonino, all of Udine; Giorgio Lavaroni, Buttrio, all of Italy

[73] Assignee: Daniele & C. Officine Meccaniche S.P.A., Buttrio, Italy

[21] Appl. No.: 762,815

[22] Filed: Dec. 9, 1996

[30] Foreign Application Priority Data

Dec. 22, 1995 [IT] Italy ..... UD95 A 000248

[51] Int. Cl.[6] ..... B21B 35/02

[52] U.S. Cl. ..... 72/235; 72/349

[58] Field of Search ..... 72/235, 249

[56] References Cited

FOREIGN PATENT DOCUMENTS

| | | | |
|---|---|---|---|
| 474217 | 7/1947 | Belgium . | |
| 0 114 793 | 8/1984 | European Pat. Off. | 72/235 |
| 118939 | 9/1984 | European Pat. Off. . | |
| 313930 | 5/1989 | European Pat. Off. . | |
| 545395 | 8/1932 | Germany . | |
| 1209535 | 1/1966 | Germany . | |
| 204415 | 11/1983 | Germany . | |
| 57-100801 | 6/1982 | Japan | 72/235 |
| 59-185513 | 10/1984 | Japan | 72/249 |
| 5-138210 | 6/1993 | Japan | 72/235 |

OTHER PUBLICATIONS

"Roll stands in modern bar and rod mills", Iron And Steel Engineer, L. Forni, vol. 59, No. 11, Nov. 1982, pp.52–55.

*Primary Examiner*—Lowell A. Larson

*Attorney, Agent, or Firm*—Stevens, Davis, Miller & Mosher, L.L.P.

[57] ABSTRACT

Compact rolling block comprising at least one rolling mill stand having a horizontal axis and at least one rolling mill stand having a vertical axis, two end rolling mill stands having the same axis and being separated by a central rolling mill stand having an axis substantially at 90° to the axes of the other two end rolling mill stands, the end rolling mill stands (11, 13) cooperating by means of extensions (18*a*, 18*c*) with a first gear casing (16) forming a support for a second gear casing (25) associated by means of extensions (18*b*) with the central rolling mill stand (12), a motor (17*b*) of the central rolling mill stand (12) being upheld by the first gear casing (16), the extensions (18*a*, 18*c*, 18*c*) associated with the respective rolling mill stands (11, 12, 13) including respective connecting bushes (28*a*, 28*b*, 28*c*) associated with support means (27, 127) which can be positioned by means of actuation units (26, 126) so as to connect/release the relative connecting bushes (28*a*, 28*b*, 28*c*) to/from respective ring-bearing shafts (14).

20 Claims, 3 Drawing Sheets

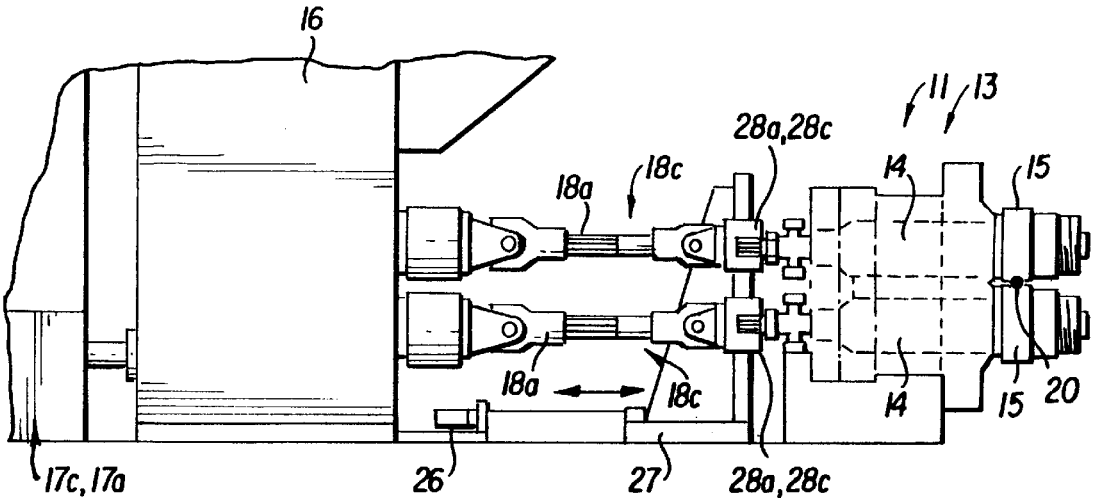
FIG. 4
FIG. 5
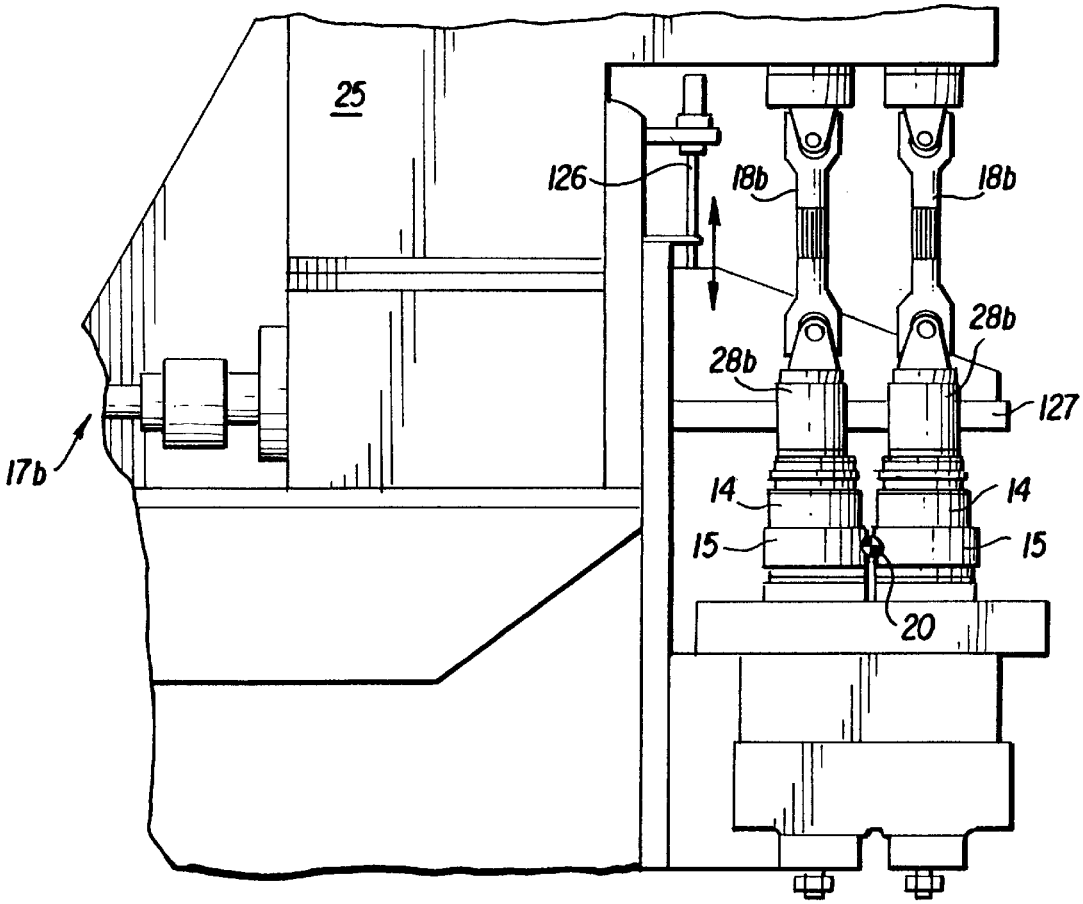

COMPACT ROLLING BLOCK

FIELD OF THE INVENTION

This invention concerns a compact rolling block

The invention is applied to the field of iron and steel production plants and, to be more exact, to the field of rolling carried out with rolling mill stands having rings supported as cantilevers and with rolling mill stands having rolls.

BACKGROUND OF THE INVENTION

Rolling lines of the field of rolling include a plurality of rolling mill stands positioned in series in which the rolled stock is reduced progressively to the desired dimension with very close tolerances for the diameter and oval form of the finished product.

The state of the art includes rolling blocks which comprise a plurality of rolling mill stands of the type with rings supported as cantilevers and of the type with rolls, these stands being positioned side by side and separated.

In the plants of the state of the art each rolling mill stand comprises its own motor and its own gear casing with resulting high costs and great overall volumes.

In fact, the inclusion of the motors and of the gear casings has the effect that the distance between adjacent rolling mill stands is great with a resulting need to use guides to guide the rolled stock at an intermediate position between the rolling mill stands.

Furthermore, as the rolling mill stands are alternately of a type with a vertical axis and of a type with a horizontal axis, the rolled stock tends to rotate along its axis between one stand and the next, thus entailing finished products of a poor quality as regards the circular nature of their cross section.

The present applicants have designed, tested and embodied this invention to overcome the shortcomings of the state of the art and to achieve further advantages.

SUMMARY OF THE INVENTION

The purpose of this invention is to provide a compact rolling block which reduces considerably the dimensions of the rolling line and enables the operations for replacement and/or maintenance to be carried out quickly and simply.

The invention is applied to rolling mill stands with rings supported as cantilevers and to rolling mill stands with rolls.

Moreover, the invention has the further purpose of reducing the vibrations and noise and also of guiding the rolled stock better and of preventing rotation of the rolled stock between one rolling mill stand and the next one, especially in the case of products involving small percentages of reduction, thus ensuring finished rolled products remaining within even smaller tolerances.

The invention is applied advantageously to compact rolling blocks having the functions of gauging means.

The compact rolling block according to the invention comprises at least one rolling mill stand having a horizontal axis and at least one rolling mill stand having a vertical axis, two end rolling mill stands with the same axis being separated by a central rolling mill stand having its axis substantially at 90° to the axes of the other two end rolling mill stands.

In a first embodiment of the invention the compact rolling block according to the invention comprises three rolling mill stands, namely two end rolling mill stands having a horizontal axis and one central rolling mill stand having a vertical axis, the two end rolling mill stands being associated with a first gear casing forming a base for a second gear casing associated with the central rolling mill stand.

According to a variant the compact rolling blocks according to the invention comprises two end rolling mill stands having a vertical axis and one central rolling mill stand having a horizontal axis.

Hereinafter we shall deal with the horizontal/vertical/horizontal variant, but shall be understood to comprise also the second vertical/horizontal/vertical variant.

According to the invention the bodies of the rolling mill stands are in close contact with each other and form a structural continuity which reduces the vibrations and makes the structure more solid and more stable.

According to a variant each rolling mill stand cooperates with a relative container so as to be able to be changed independently of the other rolling mill stands quickly and simply.

According to one embodiment of the invention the rolling mill stands are of a cartridge type.

In one particular embodiment of the invention the rolling mill stands forming the compact rolling block are of a type with rolling rings supported as cantilevers and comprise ring-bearing shafts with which the rolling rings are associated; this situation simplifies and speeds up considerably all the work of replacing the rolling elements with a resulting reduction of the costs and simplicity of replacing the rolling rings.

The ring-bearing shafts may be of a type supported on bearings working with a film of oil or of a type supported on roller bearings or ball bearings.

Moreover, the compact conformation and the rings supported as cantilevers facilitate the removal of obstructions and improve the attachment of extraction and lifting means.

According to the invention the rolling mill stands forming the compact rolling block according to the invention can be replaced individually with or without their respective container; they can also be replaced as a group together with their respective containers.

The replacement can take place also together with other rolling mill stands possibly having rolling rolls of different dimensions and possibly with different distances between centres of the stands so as to produce rolled stock of various dimensions.

The replacement can be carried out with a crane or with a transfer and positioning trolley.

According to another variant the rolling mill stands can be associated with one and the same container so as to reduce the times of replacement of all the rolling mill stands in one single operation.

Depending on the size of the rolling rolls and for the purpose of obtaining better qualities of the rolled stock as regards tolerances and circular condition, the rolling mill stands associated with the compact rolling block according to the invention can have different distances between centres.

The three rolling mill stands are connected to their respective gear casings by means of movable extensions, which can be connected up axially and are advantageously supported by movable supports.

In the compact rolling block according to the invention the rolling rings of the rolling mill stand having a vertical axis are positioned in the upper part of the stand and are associated directly with the respective extensions; this arrangement enables the height and dimensions of the compact rolling block according to the invention to be reduced.

The moving of the supports enables the extensions to be disconnected quickly and simply, thus making possible an easy corrective operation.

The rolling mill stands are driven by independent motors connected to each other mechanically or electrically so as to ensure a correct difference of peripheral speed according to the type of rolled product.

Where the assembly of the three rolling mill stands is installed on a transfer and positioning trolley, the latter cooperates with transfer guides positioned frontally and including at least one second auxiliary transfer and positioning trolley comprising another assembly of three rolling mill stands ready for use.

In this way it is possible to carry out a complete and quick replacement of the compact rolling block so as to enable maintenance work to be carried out in the workshop with greater accuracy and with all the available equipment and, therefore, with reduced replacement times, thus reducing to a minimum the downtimes of the rolling plant.

BRIEF DESCRIPTION OF THE DRAWINGS

The attached figures are given as a non-restrictive example and show some preferred embodiments of the invention as follows:

FIG. 4 is a partial side view of one of the horizontal rolling mill stands associated with the compact rolling block of FIG. 1;

FIG. 5 is a partial side view of the vertical rolling mill stand associated with the compact rolling block of FIG. 1.

DETAILED DESCRIPTION OF THE PREFERRED EMBODIMENTS

Figure 1:
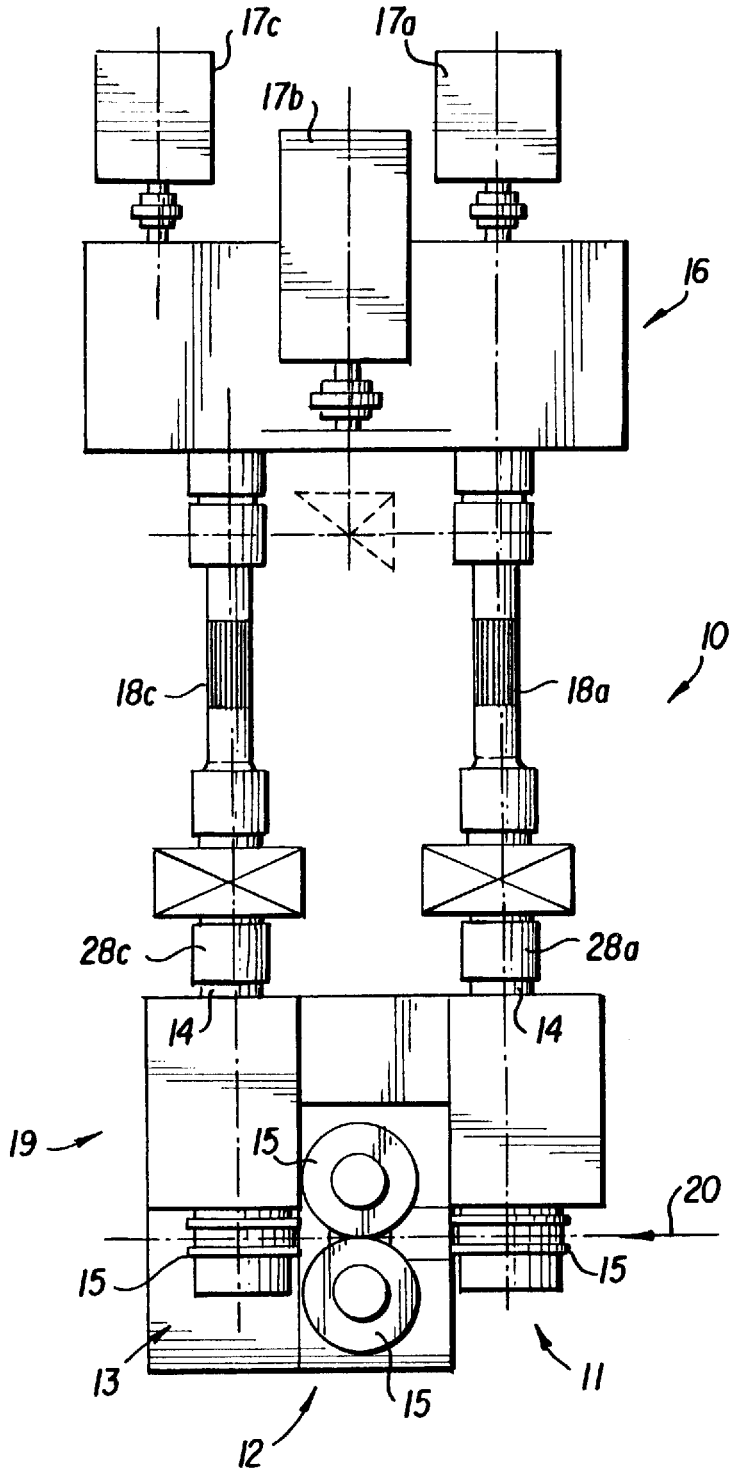
FIG. 1 is a diagrammatic plan view of a preferred form of embodiment of the compact rolling blocks according to the invention.
Figure 2:
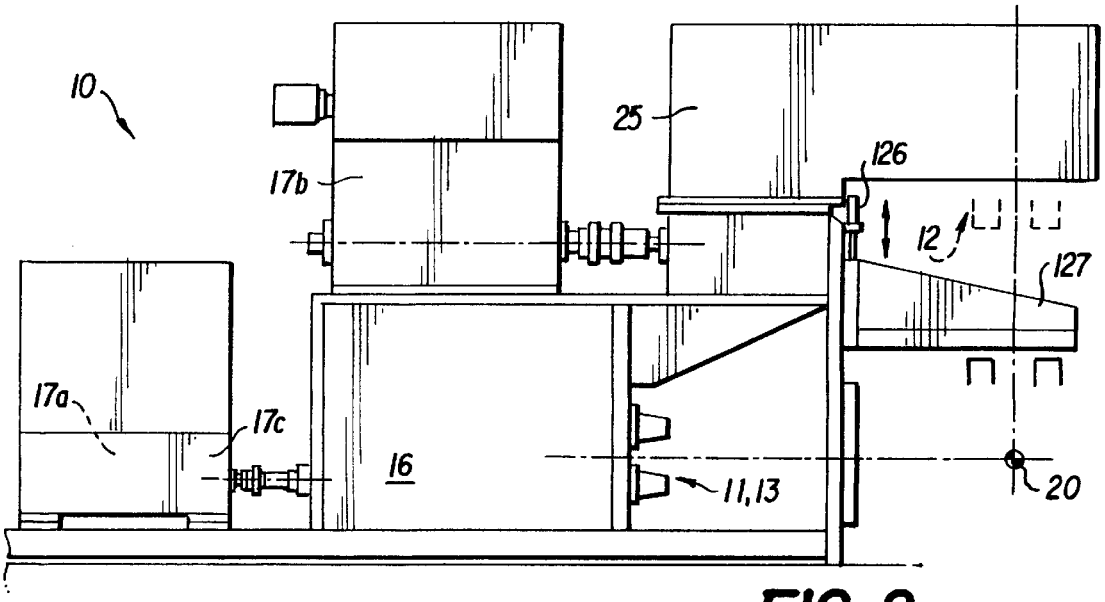
FIG. 2 is a diagrammatic side view of the compact rolling block of FIG. 1 without the ring-bearing shafts and relative extensions.

The reference number 10 in the figures denotes generally a compact rolling block according to the invention.

In this case the compact rolling block 10 shown in the figures is of a type with rolling rings supported as cantilevers.

According to a variant which is not shown here, the rolling mill stands 11, 12, 13 are of a type with rolling rolls.

According to yet another variant the rolling mill stands 11, 12, 13 are of a cartridge type.

The compact rolling block 10 according to the invention comprises three rolling mill stands, namely two end rolling mill stands 11, 13 with a horizontal axis and one central rolling mill stand 12 with a vertical axis, the stands being associated with each other.

According to a variant which is not shown here, the compact rolling block 10 according to the invention comprises two end rolling mill stands 11, 13 with a vertical axis and one central rolling mill stand 12 with a horizontal axis.

In the following description the words "horizontal" and "vertical" refer to the axes of the rolling rings or rolling rolls.

The three rolling mill stands 11, 12, 13 are in contact with each other and may even be contained in one single structure.

The rolling mill stands 11, 12, 13 of the compact rolling block 10 according to the invention are of a type with rolling rings 15 supported as cantilevers and fitted to ring-bearing shafts 14.

The compact rolling block 10 includes a first gear casing 16 with which are associated the motors 17*a*, 17*c* of the horizontal rolling mill stands 11, 13.

This first gear casing 16 forms a support for the motor 17*b*and for the second gear casing 25 associated with the central vertical rolling mill stand 12, thereby enabling the overall bulk of the compact rolling block 10 according to the invention to be reduced.

Mechanical connections between the three motors 17 may take place by means of a reduction gear system which can be connected up/disconnected in desired conditions of ratio by means of a control lever operated by the machine operator.

In the compact rolling block 10 according to the invention the ring-bearing shafts 14 of the horizontal rolling mill stands 11, 13 and of the vertical rolling mill stand 12 are connected to respective gear casings 16, 25 by means of respective extensions 18*a*, 18*c* and 18*b*.

The vertical rolling mill stand 12 has its rolling rings 15 positioned in its upper part and cooperating directly with the respective extensions 18*b* located above, thus enabling the dimensions of the compact rolling block 10 to be restricted.

The extensions 18*a*, 18*b*, 18*c* include respective terminal connecting bushes 28*a*, 28*b*, 28*c*.

The connecting bushes 28*a*, 28*b*, 28*c* are supported by support means 27, 127, which can be positioned by actuation units 26, 126 so as to connect/disconnect the respective connecting bushes 28*a*, 28*b*, 28*c* to/from the ends of the ring-bearing shafts 14.

The connecting bushes 28*b* cooperate with the end portion of the ring-bearing shafts 14 of the vertical rolling mill stand 12, on which shafts 14 are fitted the rolling rings 15.

In the compact rolling block 10 according to the invention the connecting and disconnecting of the ring-bearing shafts 14 to/from the respective extensions 18*a*, 18*b*, 18*c* are therefore carried out simply and quickly by operating the actuation units 26, 126, thus simplifying considerably the operations of maintenance and replacement.

Figure 3:
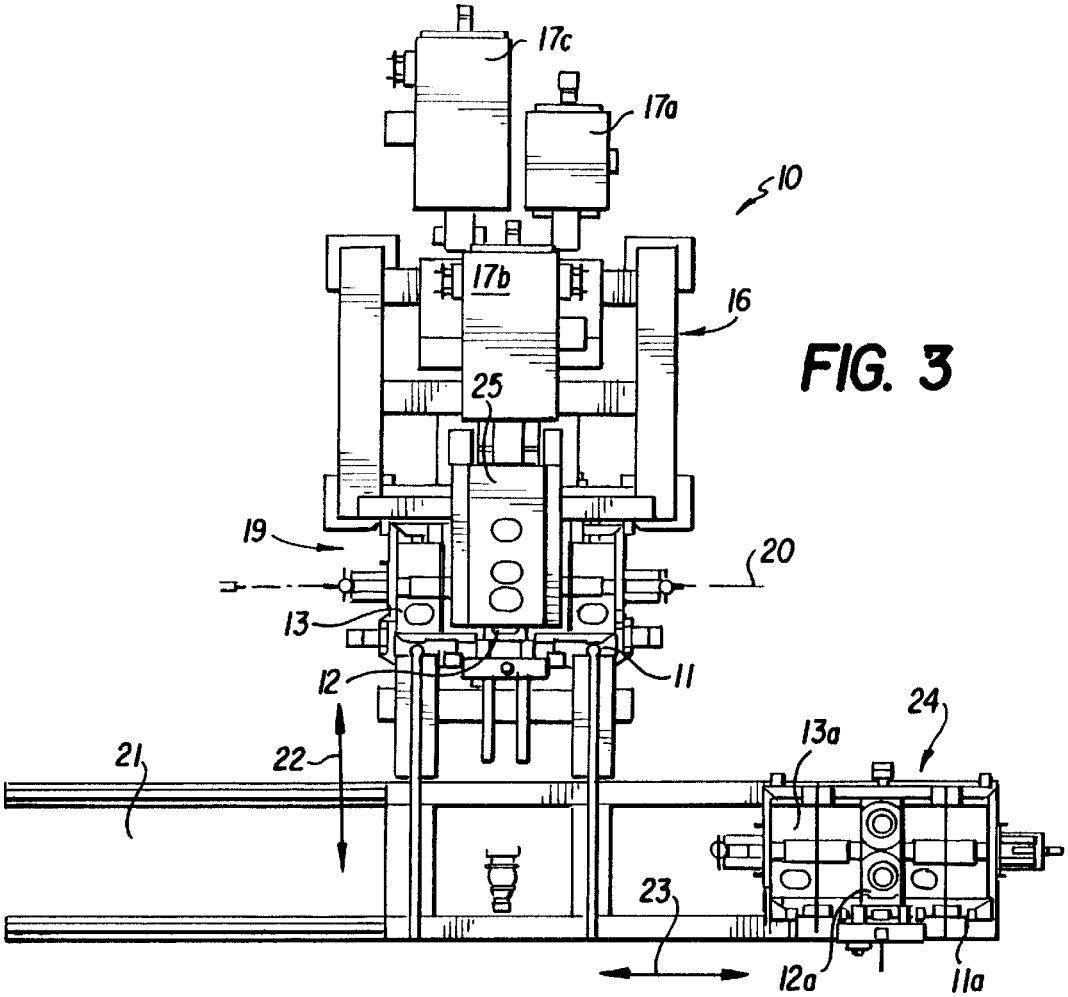
FIG. 3 is a plan view of a compact rolling block according to the invention in association with a transfer guide.

In the form of embodiment shown in FIG. 3 the three rolling mill stands 11, 12, 13 are installed on one single trolley 19, which can be moved according to the arrow 22 at a right angle to the rolling axis 20 so that that trolley 19 can be distanced when the ring-bearing shafts 14 have been disconnected from their respective extensions 18 associated with their respective gear casing 16, 25.

This transfer and positioning trolley 19 includes means for its clamping to a base; these means are not shown here but can be actuated momentarily so as to ensure a secure and accurate fixture when the trolley 19 is cooperating with the compact rolling block 10 according to the invention.

This transfer and positioning trolley 19 cooperates with transfer guides 21 on which is installed a second auxiliary trolley 24, which can be moved according to the arrow 23 and bears three other rolling mill stands 11*a*, 12*a*, 13*a* ready for use.

In this way, in the event of maintenance or of an obstruction or an accident, it is possible to replace the three rolling mill stands 11, 12, 13 with the three spare rolling mill stands

11*a*, 12*a*, 13*a* by replacing the transfer and positioning trolley 19 with the second auxiliary transfer and positioning trolley 24.

This reduces the downtimes of the rolling line and enables the operations of maintenance of the rolling mill stands 11, 12, 13 to be carried out in the workshop.

We claim:

1. A compact rolling block (10) comprising two end rolling mill stands having the same axis and being separated by a central rolling mill stand having an axis substantially at 90° to the axes of the other two end rolling mill stands, wherein at least one rolling mill stand has a horizontal axis and at least one rolling mill stand has a vertical axis, each said rolling mill stand comprising a shaft respectively provided for each said rolling mill stand axis, each said shaft provided with a rolling means, a first gear casing (16) and a second gear casing (25), the end rolling mill stands (11, 13) cooperate by extensions (18*a*, 18*c*) with the first gear casing (16), the first gear casing 16 forming a support for the second gear casing (25), the second gear casing associated by an extension (18*b*) with the central rolling mill stand (12), a motor (17*b*) of the central rolling mill stand (12) being supported by the first gear casing (16), the extensions (18*a*, 18*b*, 18*c*) associated with the respective rolling mill stands (11 , 12, 13) including respective connecting bushes (28*a*, 28*b*, 28*c*) associated with support means (27, 127) which are positionable by means of actuation units (26, 126) so as to connect/release the respective connecting bush (28*a*, 28*b*, 28*c*) to/from the respective shaft (14).

2. A compact rolling block (10) as in claim 1, in which each rolling mill stand (11, 12, 13) is driven by its own motor (17*a*, 17*b*, 17*c*), the motors (17*a*, 17*c*) of the end rolling mill stands (11, 13) being associated with the first gear casing (16).

3. A compact rolling block (10) as in claim 2, in which the three motors (17*a*, 17*b*, 17*c*) are connected to each other mechanically or electrically.

4. A compact rolling block (10) as in claim 3, in which the rolling mill stands (11, 12, 13) are cartridge-type stands.

5. A compact rolling block (10) as in claim 3, in which the rolling mill stands (11, 12, 13) are conformed with rolling rings (15) supported as cantilevers.

6. A compact rolling block (10) as in claim 3, in which the rolling mill stands (11, 12, 13) are conformed with rolling rolls.

7. A compact rolling block (10) as in claim 3, which is associated with transfer guides (21) extending frontally to the compact rolling block (10), at least one auxiliary trolley (24) being included and being able to move on the transfer guides (21).

8. A compact rolling block (10) as in claim 2, in which the rolling mill stands (11, 12, 13) are cartridge-type stands.

9. A compact rolling block (10) as in claim 2, in which the rolling mill stands (11, 12, 13) are conformed with rolling rings (15) supported as cantilevers.

10. A compact rolling block (10) as in claim 2, in which the rolling mill stands (11, 12, 13) are conformed with rolling rolls.

11. A compact rolling block (10) as in claim 2, which is associated with transfer guides (21) extending frontally to the compact rolling block (10), at least one auxiliary trolley (24) being included and being able to move on the transfer guides (21).

12. A compact rolling block (10) as in claim 1 in which the rolling mill stands (11, 12, 13) are each cartridge-type stands.

13. A compact rolling block (10) as in claim 1 in which the rolling mill stands (11, 12, 13) are conformed with rolling rings (15) supported as cantilevers.

14. A compact rolling block (10) as in claim 13, in which the rolling mill stand (12) having a vertical axis has its rolling rings (15) positioned in its upper portion and associated directly with its respective extensions (18*b*).

15. A compact rolling block (10) as in claim 1 in which the rolling mill stands (11, 12, 13) are conformed with rolling rolls.

16. A compact rolling block (10) as in claim 1 which is associated with transfer guides (21) extending frontally to the compact rolling block (10), at least one auxiliary trolley (24) being included and being able to move on the transfer guides (21).

17. A compact rolling block as in claim 1, wherein the second gear casing (25) and the motor (17*b*) of the central rolling mill stand 12 are functionally supported on an outside surface of a top wall of the first gear casing (16).

18. A compact rolling block as in claim 1, wherein the rolling mills are each distinct rolling mills.

19. The compact rolling block as in claim 1, wherein said support means comprises means (27, 127) for guiding and supporting said bushes.

20. The compact rolling block as in claim 1, the block is designed and configured to be a gauging assembly.

* * * * *

UNITED STATES PATENT AND TRADEMARK OFFICE

CERTIFICATE OF CORRECTION

PATENT NO. : 5,771,733

DATED : June 30, 1998

INVENTOR(S) : TOMAT et al

It is certified that error appears in the above-identified patent and that said Letters Patent is hereby corrected as shown below: Title page, item

[73], change "Daniele" to --Danieli--.

Signed and Sealed this

Fourteenth Day of March, 2000

*Attest:*

*Attesting Officer*

Q. TODD DICKINSON

*Commissioner of Patents and Trademarks*